US006866259B2

(12) United States Patent
Underwood et al.

(10) Patent No.: US 6,866,259 B2
(45) Date of Patent: Mar. 15, 2005

(54) HINGED-ARM PICK MECHANISM

(75) Inventors: John A. Underwood, Vancouver, WA (US); Todd R. Medin, Vancouver, WA (US); Richard A. Kelley, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 51 days.

(21) Appl. No.: 10/623,412

(22) Filed: Jul. 18, 2003

(65) Prior Publication Data

US 2004/0017038 A1 Jan. 29, 2004

Related U.S. Application Data

(63) Continuation of application No. 09/972,559, filed on Oct. 6, 2001, now Pat. No. 6,637,743, and a continuation-in-part of application No. 09/470,174, filed on Dec. 22, 1999, now Pat. No. 6,322,065.

(51) Int. Cl.[7] ..... B65H 3/06
(52) U.S. Cl. ..... 271/117; 271/118; 271/121
(58) Field of Search ..... 271/121, 31, 42, 271/118, 117

(56) References Cited

U.S. PATENT DOCUMENTS

| | | | |
|---|---|---|---|
| 3,411,768 | A | 11/1968 | Gatti |
| 3,920,238 | A | 11/1975 | Kitajima et al. |
| 4,660,820 | A | 4/1987 | Shino et al. |
| 4,990,011 | A | 2/1991 | Underwood et al. |
| 5,104,109 | A | 4/1992 | Kubo |
| 5,547,181 | A | 8/1996 | Underwood |
| 6,089,563 | A | 7/2000 | Takashimizu et al. |

FOREIGN PATENT DOCUMENTS

| | | |
|---|---|---|
| JP | 5552832 | 4/1980 |
| JP | 5278873 | 10/1993 |
| JP | 5210730 | 1/1997 |

*Primary Examiner*—Patrick Mackey

(57) ABSTRACT

A pick mechanism includes a hinged pick arm which moves between a retracted position and a varying, operating position. The pick arm is anchored about a pivot axis and hinged along its length. Rotation of a pick roller along the arm while in contact with a media sheet induces a moment on the pick arm causing the pick arm to pivot and hinge. A first stop limits the pivoting motion. A second stop limits the hinging motion, Such pivoting and hinging is desirable to create an effective normal force enabling reliable picking of thick media sheets. Such motions are limited to prevent the pick roller from translating too far from a media separation ramp. If the pick roller translates too far, undesirable media buckling may occur during the pick operation.

7 Claims, 4 Drawing Sheets

FIG. 10
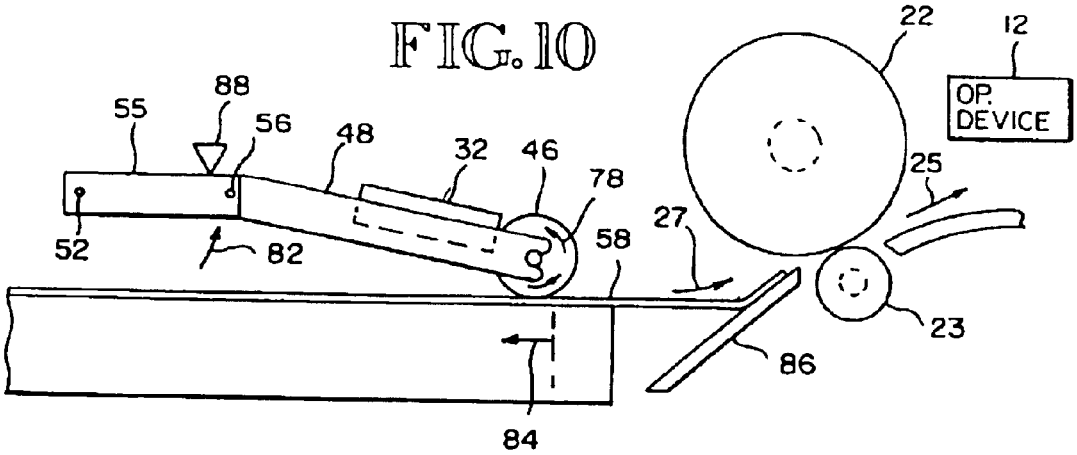
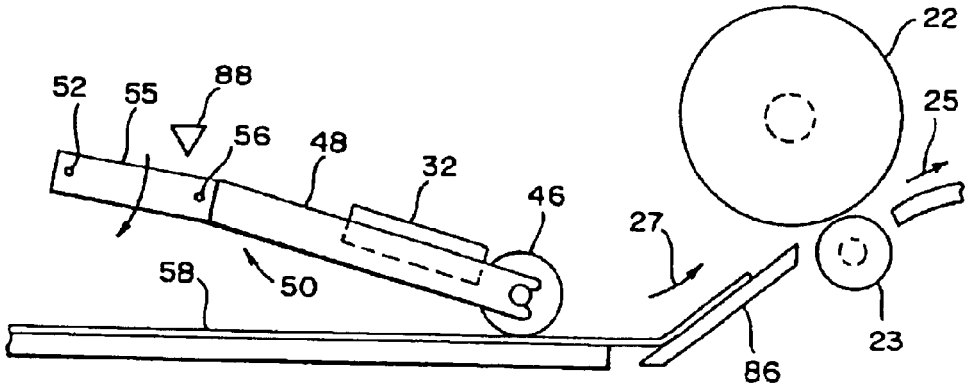
FIG. 11
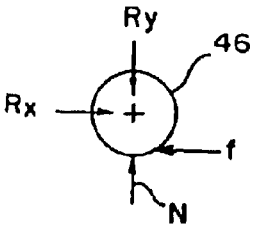
FIG. 12
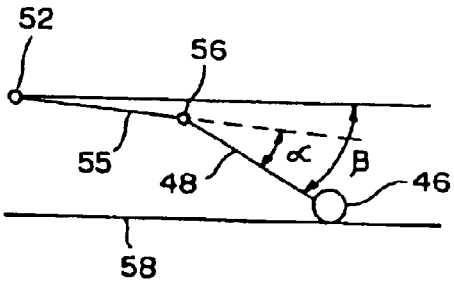
FIG. 13

HINGED-ARM PICK MECHANISM

CROSS REFERENCE TO RELATED APPLICATION

This application is a continuation of U.S. application Ser. No. 09/972,559 with the same title and filed Oct. 6, 2001 now U.S. Pat. No. 6,637,743 application Ser. No. 09/470,174 is a continuation in part of U.S. Pat. No. 6,322,065 with the same title and issued Nov. 27, 2001 on an application filed Dec. 22, 1999.

BACKGROUND

This invention relates generally to media sheet feed mechanisms, and more particularly, to a media sheet pick and feed system which operates effectively regardless of media tray content and which enables easy re-loading of the media tray.

Print recording devices, such as printers, fax machines and copy machines, and print scanning devices often include an input media tray. A media sheet is picked from the input tray and fed along a media path to receive print recording or to undergo print scanning. One common mechanism for picking and feeding a media sheet employs a D-shaped wheel. During rotation of the wheel the curved portion contacts and picks a media sheet. Subsequent to the pick action the flat portion of the D-shaped wheel is adjacent to the picked media sheet, but out of contact with the media sheet. The media sheet is fed from the media tray while the flat portion of the wheel is adjacent but out of contact with the media sheet.

Another known pick mechanism includes a drive gear mounted on a shaft which in turn is coupled to a drive motor. The drive motor turns the shaft and drive gear during a pick operation. The drive gear engages a driven gear to which is rigidly connected a pick roller. Thus, the drive motor rotates the pick roller. The pick mechanism is moved into and out of contact with a media sheet to be picked by the rotation of the drive gear. When the drive gear rotates in one direction the driven gear and pick roller move into contact with a media sheet. Continued rotation in such direction causes the media sheet to be picked and moved onto a media feed path. Typically, rotation in the opposite direction causes the drive gear and pick roller to move out of contact with the media sheet. A shortcoming of this mechanism is that a spring-loaded tray is needed to bias the media sheets toward the pick range of the pick roller. Further, the media tray needs to be removed during reloading (or alternatively a mechanism is needed during reloading to depress the spring-loading plate which raises a media sheet into the pick range).

In U.S. Pat. No. 5,547,181 issued Aug. 20, 1996 to Underwood for "Media Sheet Pick and Feed System," Underwood discloses a clutch mechanism which allows the pick roller to remain in contact with the media sheet as the media e media tray along the feed path. In particular, the clutch disengages the drive gear from the drive motor allowing the pick roller (along with the drive gear and driven gear) to "free" wheel. This approach eliminates the need for a spring-loaded media tray.

DESCRIPTION OF THE DRAWINGS

FIG. 10 is a diagram of a portion of the media transport assembly with the pick arm in an operative position and a media sheet being picked from a media stack.

FIG. 11 is a diagram of a portion of the media transport assembly with the pick arm in an operative position and a media sheet being picked from a smaller media stack.

FIG. 12 is a force diagram of the forces acting on a pick roller at a point where the pick roller contacts a media sheet.

FIG. 13 is a line diagram depicting the angles which the pick arm portions form.

DETAILED DESCRIPTION

Overview

Figure 1:
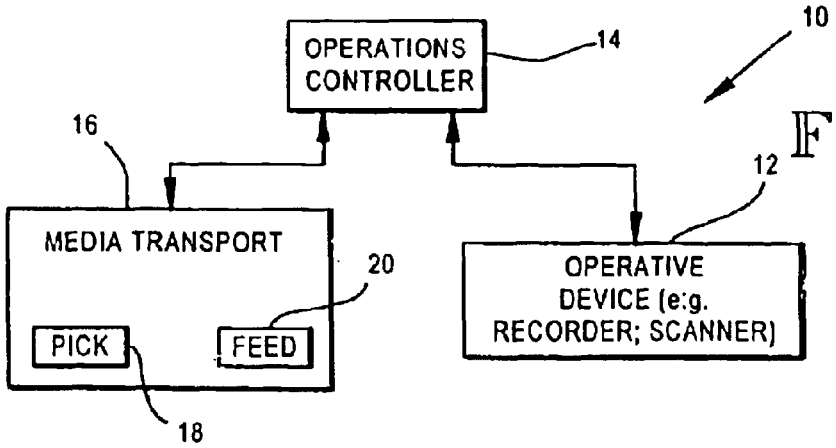
FIG. 1 is a block diagram of an exemplary host system for the pick arm mechanism.

The pick arm mechanism of this invention is implemented in a print recording system or a print scanning system, such as a printer, a fax machine, a copy machine, or an optical scanning device. Referring to FIG. 1, such a system 10 includes an operative device 12, such as a print recording device or a print scanning device, along with an operations controller 14 and a media transport assembly 16. The system 10 responds to commands input at a user interface panel (not shown) or input from a host device (e.g., a computer) to which the system 10 is coupled. In response to the command, the operations controller 14 generates signals which are sent to the media transport system 16 to move a media sheet into position for an operation (e.g., print recording; media scanning) by the operative device 12.

Typically the system 10 includes an input tray including a stack of media sheets. A media sheet is picked from the stack and then fed along a feed path. Accordingly, the media transport assembly 16 includes mechanisms for a pick function 18 and mechanisms for a feed function 20.

Figure 2:
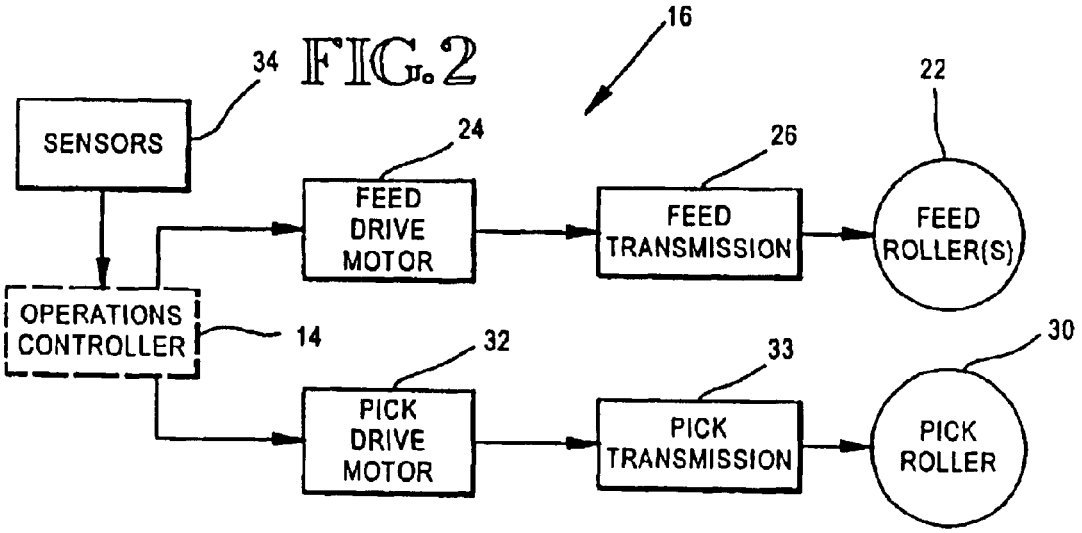
FIG. 2 is a block diagram of a media transport assembly according to one embodiment.

Referring to FIG. 2, in one embodiment the media transport assembly 16 includes one or more feed rollers 22 driven by a feed drive motor 24 through a feed transmission 26. The transmission 26 typically includes a gear chain for mechanically coupling the feed rollers 22 to the drive motor 24. The media transport assembly 16 also includes a pick roller 30 driven by a pick drive motor 32 through a pick transmission 33. The feed drive motor 24 and the pick drive motor 32 respond to signals received from the operations controller 14. In addition, sensors 34 are included which provide information to the operations controller 14 to allow desired control of operations. For example, a media position sensor is often included which enables the operations controller 14 to determine when to signal one of the drive motors 24, 32 to stop or reverse directions.

Figure 3:
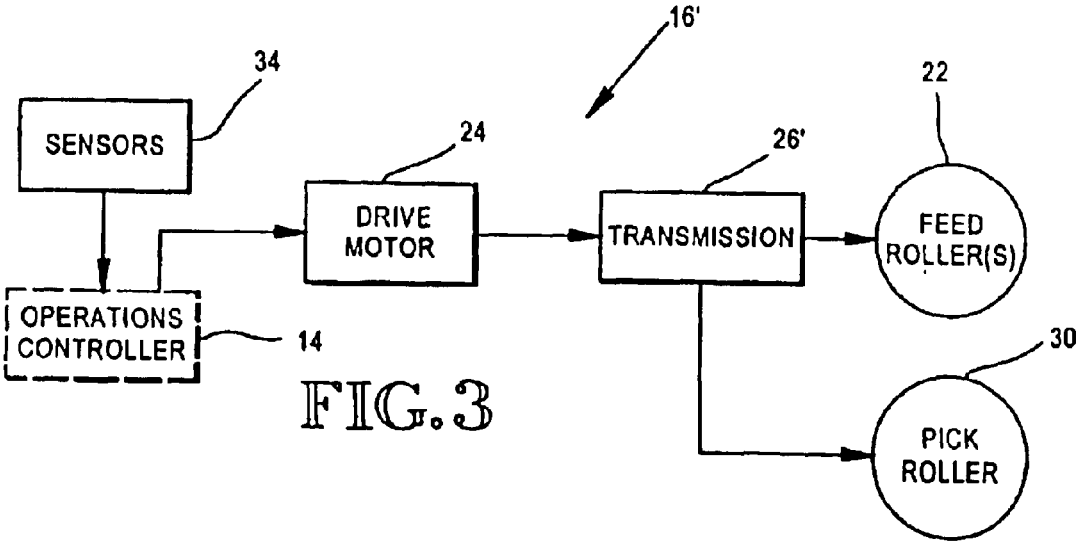
FIG. 3 is a block diagram of a media transport assembly according t another embodiment.

Referring to FIG. 3, in an alternative embodiment the pick roller 30 is driven by the same drive motor 24 as the feed rollers 22. In such embodiment a transmission 26' links both the feed rollers 22 and the pick roller 30 to the common drive motor 24.

Hinged Pick Arm

Figure 4:
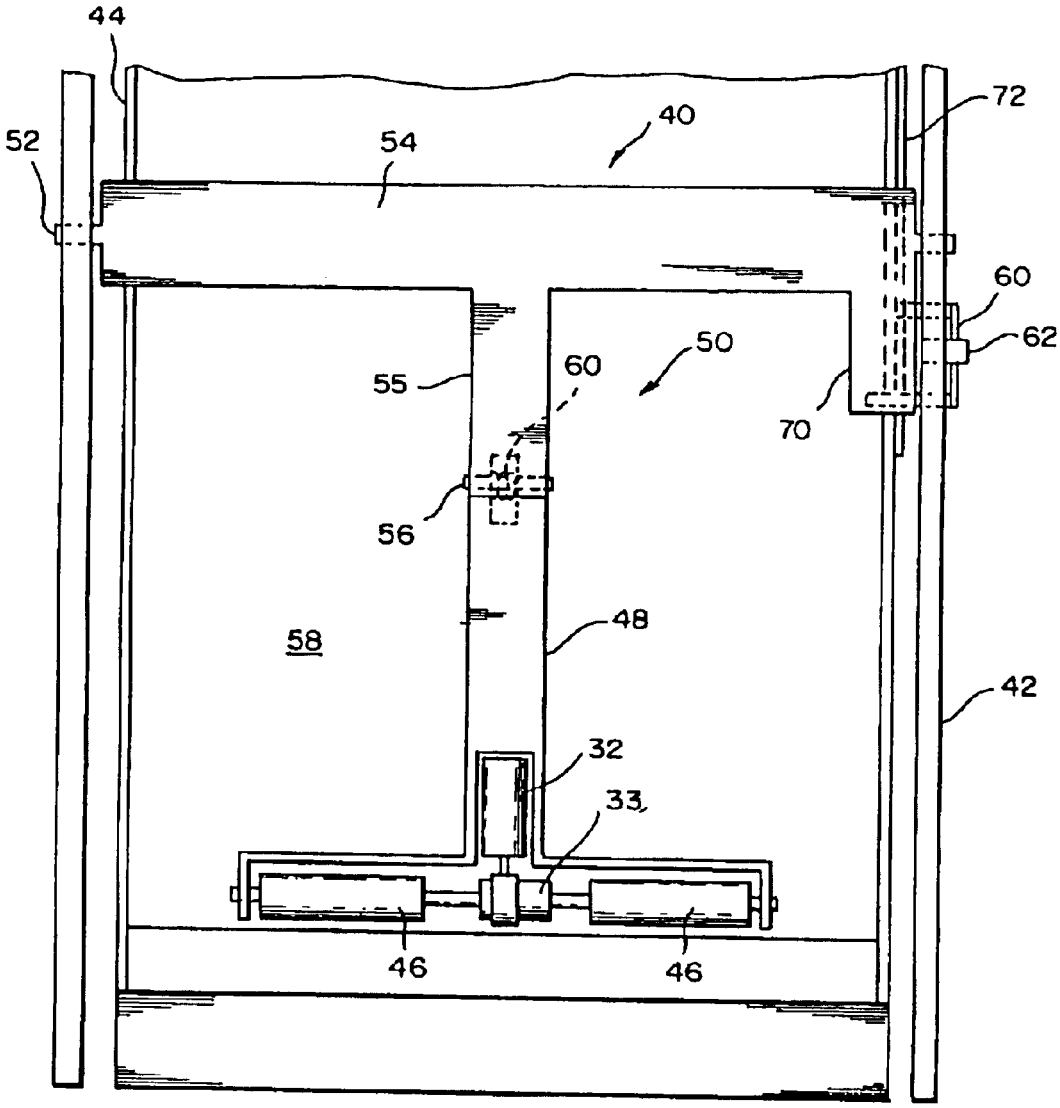
FIG. 4 is a planar view of the pick arm assembly according to an embodiment of this invention, as shown with a frame and an input tray.

Referring to FIG. 4, a pick arm assembly 40 is shown mounted to a frame 42 which also supports an input tray 44. The pick arm assembly 40 includes one or more pick rollers 46, the pick drive motor 32 and the pick transmission 33, mounted to a distal portion 48 of a hinged pick arm 50. Wires (not shown) or other signal transport medium couple the motor 32 to the operations controller 14.

The pick arm assembly 40 is mounted to the frame 42 at an axle 52 which extends along a transverse section 54 of the assembly 40. In one embodiment the pick arm assembly 40 is free to rotate about the axle 52 within a given rotational range of motion. In another embodiment the axle 52 may be coupled to a transmission which also is coupled to the pick rollers 46. The pick arm 50 includes a first portion 55 (also referred to as the proximal portion) located proximal to the transverse section 54 and a second portion 48 (also referred to as the distal portion) located distally from the transverse section 54.

Figure 5:
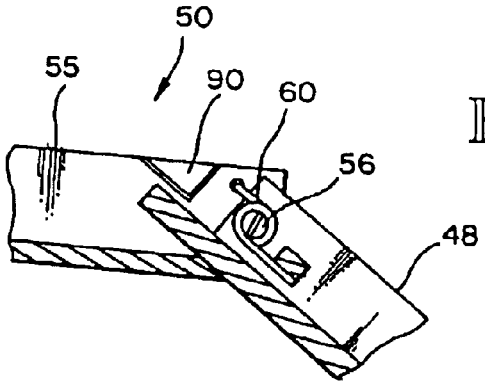
FIG. 5 is a partial view of a hinge point of the pick arm shown in FIG. 4.
Figure 6:
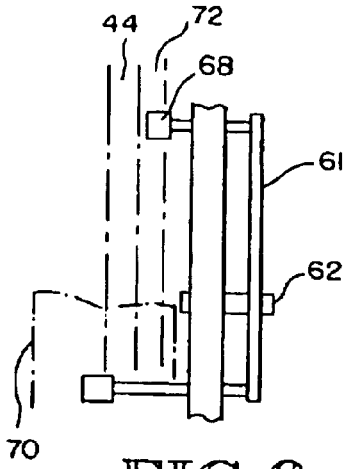
FIG. 6 is a view of a cam mechanism for retracting the pick arm of FIG. 4.
Figure 7:
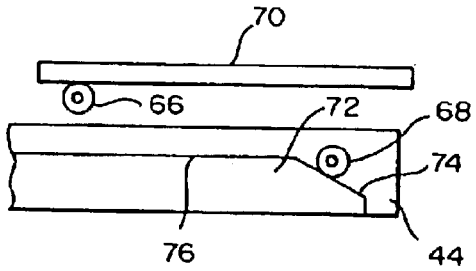
FIG. 7 is a view of a cam contact points relative to the pick arm and input tray.

The pick arm 50 is hinged at a hinge axis 56. The distal portion 48 moves with one degree of freedom relative to the proximal portion 55 about the hinge axis 56. In other embodiments additional degrees of freedom are implemented to also allow the distal portion to slide or translate longitudinally relative to the proximal portion 55. In a preferred embodiment the distal portion 48 is spring-biased to maintain the distal portion 48 at a first orientation relative to the proximal portion 55. In the best mode embodiment the first orientation is straight, although an angular orientation may be implemented instead. Various spring-like mechanisms may be used to implement the spring biasing. Referring to FIG. 5, in one embodiment a torsion spring 60 provides the bias to maintain the hinged pick arm 50 in the first orientation. In other embodiments, a compression spring, tension spring, leaf spring or sheet metal spring may be used. Still other known spring-like mechanisms may be used instead.

Pick Arm Movement Between Retracted Position and Operative Position

Figure 8:
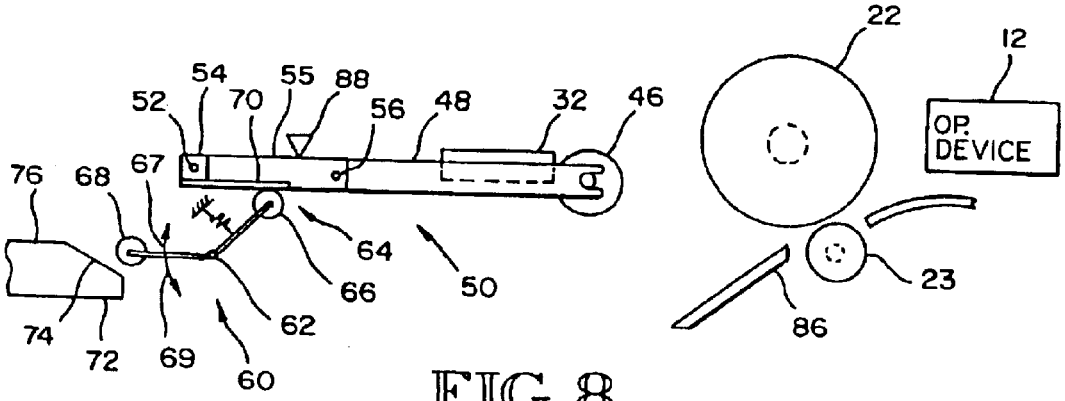
FIG. 8 is a diagram of a portion of the media transport assembly with the pick arm in a retracted position.
Figure 9:
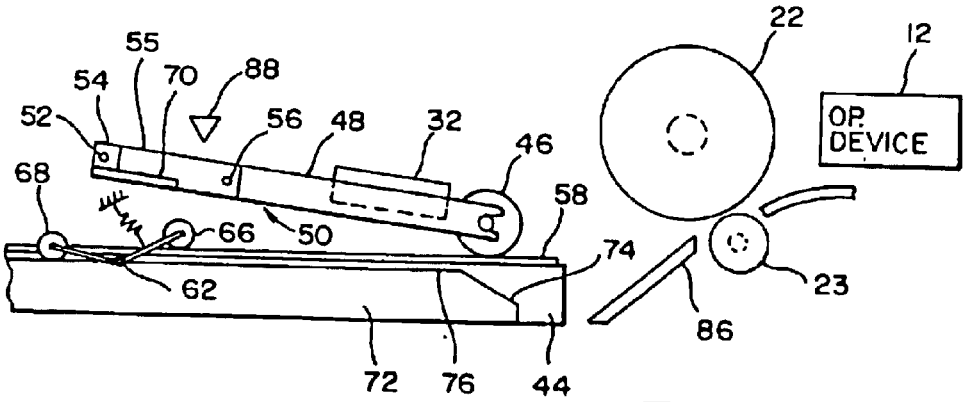
FIG. 9 is a diagram of a portion of the media transport assembly with the pick arm in a down position.

Referring again to FIG. 5, the hinged pick arm 50 rotates about an axis defined by the axle 52. The pick arm 50 moves into an operative position adjacent to a media sheet 58 during a pick operation. It also is desirable that the pick arm 50 be retracted when the input tray 44 is removed, so that the tray 44 does not bump the pick arm 50 upon re-insertion. There are various known methods for moving a pick am between a retracted position and an operative position. Referring to FIGS. 4, 6, 7, 8, and 9, in one embodiment, a cam 61 is included to control the retraction of the pick arm 50. The cam 61 is biased (see FIG. 8) to maintain the pick arm 50 in a retracted position 64. The cam 60 moves about an axis 62 and includes two contact points 66, 68. One contact point 66 enters physical communication with the pick arm assembly 40 at an area 70 as the cam 60 is biased to move the pick arm into the retracted position 64. The other contact point 68 receives physical communication from the input tray 44 along a rail 72 when the input tray is inserted into frame 42. In some embodiments the cam 60 is spring-biased as shown in FIGS. 8 and 9. In other embodiments the cam 61 is biased into the retracted position 64, instead, by having a balance point away from axis 62.

As the input tray 44 is inserted, the rail 72 contacts the point 68 of the cam 60. The rail 72 has an inclined portion 74 where contact first occurs. As the tray 44 is pushed into the frame 42, the point 68 moves up the inclined portion 74 of the rail 72, then along a flat portion 76. As the contact point 68 moves up the incline 74, the cam 60 rotates about axis 62 in direction 67. Cam 60 is a rigid structure so contact point 66 rotates with the cam 60 moving the contact point 66 in a direction away from the pick arm 50. The pick arm 50 under its own weight falls, or more specifically rotates about axle 52, to stay supported by the contact point 66. During the rotation of the cam 60, the pick arm 50 eventually rotates enough for the pick roller 46 to make contact with the media sheet 58. The pick arm 50 is entering an operative position. As rotation of the cam 60 continues, the contact point 66 separates from the portion 70, as shown in FIG. 9. While the tray 44 remains installed the contact point 66 is kept away from the pick arm. In some embodiments the pick arm section 70 rotates back into contact with the contact point 66 with the picking of the last media sheet from the input tray 44. As a result, the normal force applied by the pick roller 46 on the empty tray 44 is reduced. This avoids damage to the pick arm and pick roller 46 in the event that a pick operation is attempted while the input tray is empty. In other embodiments a sensor is used to signal that the tray 44 is empty, so that a pick operation does not occur.

Upon removal of the input tray 44, the cam 60 rotates in direction 69 which causes the contact point 66 to contact section 70 and left the pick arm into the extracted position. The cam 60 is biased to rotate in the direction 68 either by a spring or another biasing method (e.g., relative weights of cam links about the axis 62).

Hinging of the Pick Arm

During the pick operation, the operations controller 14 signals the pick drive motor 32 to rotate the pick roller 46 in a pick direction 78 (see FIG. 10). When the pick roller begins to move, it applies a translation force to the media sheet. Ignoring acceleration of the roller, this translation force is resisted by equal and opposite forces consisting of a separation force and the friction between the sheet being picked and the sheet below it. The separation force, in the example described, is a force acting on the leading edge of the sheet being picked, applied by the separation ramp when the sheet runs into it. The translation force applied by the roller will continue to increase until the sheet bends at the ramp, allowing it to picked out of the tray. Referring to FIG. 12, horizontal and vertical components, $R_x$ and $R_y$, of a reaction force act upon the roller 46 at roller bearings. These forces are reaction forces balancing the forces N and f applied by the sheet 58 to the roller 46.

The resisting forces, applied by the sheet to the roller induce a moment at the pivot point 52. When the moment exceeds the spring force that biases the pivot arm 50 into the first orientation, the distal portion 48 and proximal portion 55 hinge at the hinge axle 56, as shown in FIG. 10. Because the pick arm is fixed at the axle 52, the proximal portion 55 rotates about the axle 52 in the direction 82. As a result the pick roller 46 translates slightly in the direction 84 away from a media separation ramp 86. When the input tray 44 is filled with media sheets the proximal portion 55 rotates in the direction 82 until it reaches a mechanical stop 88. In one embodiment the mechanical stop 88 is positioned so as to allow the proximal portion 55 to return to the same place as when the entire arm 50 is retracted. In one embodiment this is a position which extends generally parallel to the media sheet 58. Due to the hinging at hinge point 56, however, the pick arm has a second orientation different than the first orientation, in which the distal portion 48 is out of the retracted position. FIG. 10 shows the pick arm 50 in an operative position for picking a media sheet 58.

Referring to FIG. 13, an angle α is defined as 180 degrees minus the angle formed between the proximal portion 55 and the distal portion 48. Angle β is defined as the angle formed between the distal portion 48 and the media sheet 58. In an embodiment in which the mechanical stop 88 is positioned to keep the proximal portion 55 parallel to the media sheet 58, angle α equals angle β as long as the proximal portion 55 is in contact with the mechanical stop 88.

In some embodiments the angle α is limited by another stop mechanism 90 (see FIG. 5). The distal portion 48 can only rotate to a limited angle relative to the proximal portion 55 before being stopped by stop mechanism 90.

As the media sheets are picked from the input tray 44, the height of the media stack decreases. While the stack is high, the angle a increases as the media stack height decreases. Eventually angle a reaches a maximum angle where the mechanical stop 90 prevents further increases in angle a As the media stack continues to be reduced in height, the pivot arm 50 then rotates about the axle 52 keeping angle a fixed at the maximum angle. In other embodiments the spring constant for the spring 60 biasing the hinge point 56 is selected so as to overcome the moment exerted on it by the translation force when angle α reaches a prescribed angle. In such embodiment the spring 60 serves as the stop mechanism 90 which limits angle α to some maximum angle.

An advantage of hinging the pick arm 50 is that picking becomes more effective as angle a is increased to some maximum angle. Referring to FIGS. 10 and 12, the normal force N acting on the pick roller 46 increases as angle a increases. As the normal force increases, the available pick force ($\mu$N) also increases. Accordingly, as the normal force N acting on the pick roller 46 increases, it becomes easier to pick heavier media sheets. Stated another way, picking of heavier media sheets is more effective as the normal force N increases. Correspondingly, picking of heavier media sheets is more effective as angle α increases.

There is also a trade-off, however. As the angle α increases the pick roller 46 translates away from the media separation surface 86. As the pick roller gets farther from the media separation surface 86 there is more likelihood of undesirable media sheet buckling. Accordingly, it is desirable to limit the amount of translation. One manner of doing so is to limit the angle α to a maximum angle using the angle stop mechanism 90 or by appropriately selecting a spring constant for spring 60. Once the maximum of angle α is reached, the pick arm no longer hinges at axle 56, but instead pivots at axle 52. As a result, there is relatively less translation of the pivot roller 46 per unit drop in height while the media stack continues to decrease in height toward an empty input tray 44.

In an alternative embodiment the translation is minimized not by limiting angle α but instead by limiting angle β. To do so, a stop mechanism is mounted to stay in the same horizontal position relative to the input tray while dropping vertically by the same amount as the paper stack decreases in height. Thus, regardless of the stack height, the stop mechanism limits angle β to a maximum angle.

Method for Picking a Media Sheet

In one embodiment the pick arm 50 is lowered adjacent to a media sheet 58 when the media input tray 44 is inserted into frame 42, as shown in FIGS. 8 and 9. With the pick arm 50 in the position shown in FIG. 9, the operations controller 14 signals the pick drive motor 32 to rotate the pick roller 46. In an alternative embodiment the driving of the pick roller causes the pick arm to lower into position to begin a pick operation. In such alternative embodiment, the pick arm retracts after the pick operation (or after the media sheet is fed along the media path).

With the pick roller rotating while in contact with the media sheet 58, the translation force applied by the roller to the media sheet causes the media sheet to move in direction 27 toward a media separation ramp 86. The separation ramp resists the motion of the sheet, causing the translation force to increase and allowing only the top sheet to be picked. The top media sheet moves into contact with a feed roller 22 and a pinch roller 23. When the leading edge of the media sheet 58 is captured between the feed roller 22 and pinch roller 23, the media sheet is pulled out of the input tray 44 onto a media path 25. The media sheet 58 then is driven along the media path by one or more feed rollers 22.

As the pick roller 46 rotates while in contact with the media sheet 58, the forces applied by the media sheet to the roller, opposing the translational force, cause a moment to act upon the pick arm 50 which causes the pick arm 50 to hinge at hinge point 56. As a result the arm pivots about axle 52 and hinges about hinge point 56 until the proximal portion 55 of the arm 50 reaches a mechanical stop 88. As the media stack gets lower (see FIG. 11), a second mechanical stop 90 limits the angle formed between the proximal portion 55 and the distal portion 48. As a result, the proximal portion 55 rotates away from the mechanical stop 88 as the weight of the arm 50 acts to keep the pick roller 46 in contact with the media sheet 58.

In some embodiments the pick arm is retracted after a picking operation. In the embodiment illustrated, the pick arm 50 remains in contact with the media stack until the input tray 44 is removed (see FIG. 8).

Meritorious and Advantageous Effects

One advantage of the invention is that media sheets of varying weights are effectively picked from a media sheet stack without media buckling.

Although a preferred embodiment of the invention has been illustrated and described, various alternatives, modifications and equivalents may be used. Therefore, the foregoing description should not be taken as limiting the scope of the invention which are defined by the appended claims.

What is claimed is:

1. A print recording system for recording print onto a media sheet which is picked from a media stack, the system comprising:

a pick arm having a proximal portion and a distal portion, the distal portion connected to the proximal portion at a hinge point, the distal portion hinging relative to the proximal portion at the hinge point, the pick arm being anchored at a pivot point along the proximal portion away from the hinge point, the pick arm rotating relative to the pivot point;

a pick roller coupled to the distal portion away from the hinge point;

a drive motor for rotating the pick roller, the drive motor mounted to the distal portion of the pick arm; and a means for inducing a moment on the pick arm which causes the proximal portion to pivot relative to the pivot point and causes the distal portion to hinge relative to the hinge point, said inducing means inducing the moment while the drive motor rotates the pick roller with the pick roller in contact with the media sheet allowing for effective picking of the media sheet from the media stack.

2. A method for picking a media sheet from a media stack with a pick roller, the pick roller located along a distal portion a hinged pick arm, the pick arm having a proximal portion located proximal to a hinge point, the distal portion located distal to the hinge point, the method comprising:

positioning the pick roller into contact with the media sheet, said contact introducing a first force onto the media sheet;

a drive motor, mounted to the distal portion of the pick arm, rotating the pick roller while in contact with the media sheet, said rotation introducing a second force to the media sheet, wherein a responsive force occurs from the media sheet back to the roller in response to the first and second forces, said responsive force inducing a moment at the hinge point as the pick roller rotates, the moment causing the distal portion to move about the hinge point relative to the proximal portion; and advancing the media sheet from the stack to pick the media sheet as the first and second forces overcome the responsive force.

3. The method of claim 2, further comprising biasing the distal portion is a first orientation relative to the proximal portion and wherein the moment causes the distal portion to move about the hinge point into a second orientation relative to the proximal portion.

4. The method of claim 2, further comprising limiting the movement of the distal portion about the hinge point relative to the proximal portion caused by the moment.

5. The system of claim 1, further comprising a spring biasing the distal portion in a first orientation relative to the proximal portion and wherein the responsive force urges the distal portion into a second orientation relative to the proximal portion.

6. The system of claim 5, wherein the spring is a torsion spring located at the hinge point.

7. The system of claim 1, further comprising a stop positioned to limit the hinging of the distal portion relative to the proximal portion at the hinge point.

* * * * *